US010364983B2

(12) United States Patent
McMillon

(10) Patent No.: US 10,364,983 B2
(45) Date of Patent: Jul. 30, 2019

(54) BURNER FLAME CONTROL

(71) Applicant: Halliburton Energy Services, Inc., Houston, TX (US)

(72) Inventor: Christopher Michael McMillon, Wylie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 175 days.

(21) Appl. No.: 15/560,369

(22) PCT Filed: Apr. 21, 2015

(86) PCT No.: PCT/US2015/026905
§ 371 (c)(1),
(2) Date: Sep. 21, 2017

(87) PCT Pub. No.: WO2016/171674
PCT Pub. Date: Oct. 27, 2016

(65) Prior Publication Data

US 2018/0073733 A1 Mar. 15, 2018

(51) Int. Cl.
*F23D 14/74* (2006.01)
*F23L 7/00* (2006.01)
(Continued)

(52) U.S. Cl.
CPC ..... *F23D 14/74* (2013.01); *F23D 14/72* (2013.01); *F23D 14/84* (2013.01); *F23G 7/08* (2013.01); *F23L 7/00* (2013.01)

(58) Field of Classification Search
CPC ..... F23D 14/76; F24D 14/74; F23L 7/00
(Continued)

(56) References Cited

U.S. PATENT DOCUMENTS 3,748,080 A 7/1973 Dunn
4,116,388 A 9/1978 Trozzi
(Continued)

FOREIGN PATENT DOCUMENTS

EP 2743581 A1 6/2014
KR 10-2006-0020122 A 3/2006

OTHER PUBLICATIONS

International Search Report and Written Opinion issued in related PCT Application No. PCT/US2015/026905 dated Jan. 11, 2016, 13 pages.

(Continued)

*Primary Examiner* — Gregory L Huson
*Assistant Examiner* — Nikhil P Mashruwala
(74) *Attorney, Agent, or Firm* — John W. Wustenberg; Baker Botts L.L.P.

(57) ABSTRACT

A system and method for controlling the direction of a burner flame exposed to potentially impinging wind or other air flows. At least one fluid nozzle is mounted in proximity to a burner nozzle. The fluid nozzle is configured to produce a spray of fluid provided by a fluid supply system. As the spray is produced, an area of low pressure is created near the fluid nozzle, creating a buffer air flow around the spray. The buffer air flow is directed towards the potentially impinging air flow such that at least a portion of the potentially impinging air flow is counteracted and no longer impinges upon the burner flame. One or more fluid nozzles may be used in the burner flame control system to counteract one or more air flows. The burner flame control system may also include one or more sensors for providing feedback to an operator or control system capable of adjusting the burner control system by, for example, changing the spray pattern, position, or orientation of the nozzle or by changing the volume and pressure of fluid supplied to the fluid nozzle.

17 Claims, 4 Drawing Sheets

(51) Int. Cl.
*F23D 14/72* (2006.01)
*F23D 14/84* (2006.01)
*F23G 7/08* (2006.01)

(58) Field of Classification Search
USPC ..... 431/5, 11
See application file for complete search history.

(56) References Cited

U.S. PATENT DOCUMENTS

| | | | | |
|---|---|---|---|---|
| 4,128,388 | A * | 12/1978 | Freze | F23C 1/08 431/116 |
| 5,466,148 | A * | 11/1995 | Witteveen | F23C 9/006 431/116 |
| 6,986,658 | B2 | 1/2006 | Stephens et al. | |
| 2012/0064465 | A1* | 3/2012 | Borissov | F23L 15/00 431/12 |
| 2014/0113238 | A1* | 4/2014 | Kiarostami | F23D 11/10 431/2 |

OTHER PUBLICATIONS

International Preliminary Report on Patentability issued in related PCT Application No. PCT/US2015/026905, dated Nov. 2, 2017, 10 pages.

* cited by examiner

BURNER FLAME CONTROL

CROSS-REFERENCE TO RELATED APPLICATION

The present application is a U.S. National Stage Application of International Application No. PCT/US2015/026905 filed Apr. 21, 2015, which is incorporated herein by reference in its entirety for all purposes.

BACKGROUND

Burners, also referred to as flares, are used across a wide range of industries to combust flammable gases. The applications of burners are broad. For example, burners may be used as part of a safety system to combust gases released by pressure relief valves or other safety equipment during plant upset conditions. A burner may also be used to combust process byproducts that may not be economically feasible to transport and/or store for later use. For example, in the oil and gas industry, production of crude oil from an oil well generally results in the simultaneous production of natural gas. This natural gas may be reinjected into the oil well to maintain well pressure or transported and stored at a separate location for later use. However, remote and offshore production facilities may lack a connection to a pipeline or other system for transporting and storing the natural gas. Therefore any excess natural gas that cannot be reinjected or otherwise used at the production facility is generally sent to a burner to be combusted.

The flame produced by a burner may be large and intense and may pose a significant risk to nearby personnel and equipment. Compounding the danger associated with the burner flame's size and intensity is the fact that most burners combust gases to atmosphere and, as a result, the burner flame is exposed to wind and other air flows. As these air flows impinge upon the burner flame, the burner flame and the heat it produces may be directed towards undesirable locations, such as those in which equipment is installed or that are accessible by personnel. In light of these potential safety concerns, a system for minimizing the effects of impinging air flows is desirable.

BRIEF DESCRIPTION OF THE DRAWINGS

A more complete understanding of the present embodiments and their advantages may be acquired by referring to the following description taken in conjunction with the accompanying drawings, in which like reference numbers indicate like features.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to burners and flares as used in the oil and gas and chemical industries. More specifically, the present disclosure relates to a system and method for controlling a flame produced by a burner by reducing the effects of wind or other air flows on the burner flame.

Illustrative embodiments of the present invention are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of this disclosure, the following examples of certain embodiments are given. In no way should the following examples be read to limit, or define, the scope of the claims. For example, the following description is provided in the general context of an offshore oil and gas platform. However, those of ordinary skill in the art would appreciate that the methods and systems discussed herein could be readily adapted to other burner applications, such as onshore oil and/or gas wells, petroleum refineries, natural gas processing plants, and chemical plants. Moreover, to the extent the description below is limited to substantially horizontal burners, one of ordinary skill would appreciate that the systems and methods described herein are also applicable to vertically oriented burners or burners in orientations other than vertical and horizontal.

Figure 1A:
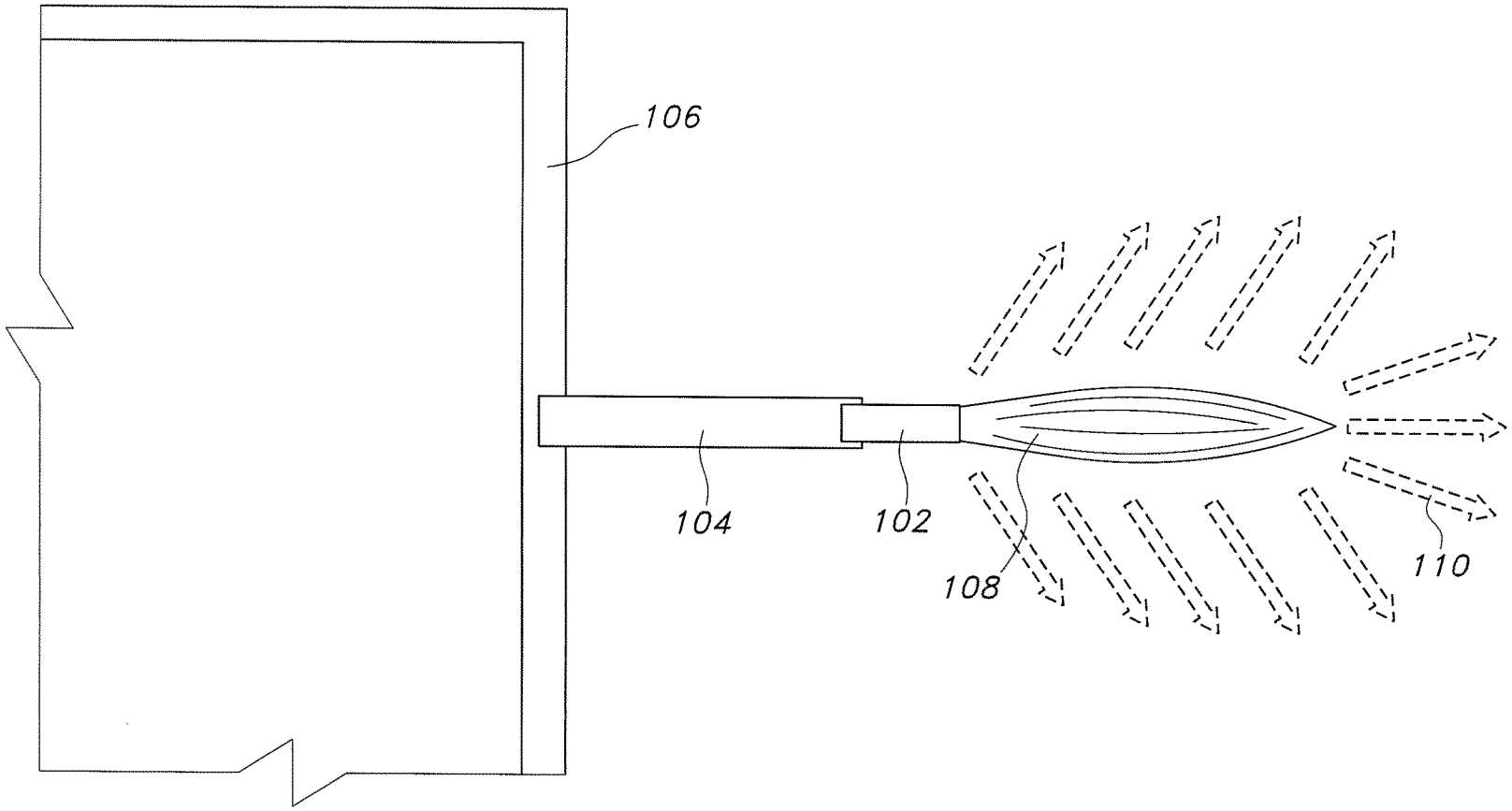
FIG. 1A is a top-down view of a burner of an offshore platform.
Figure 1B:
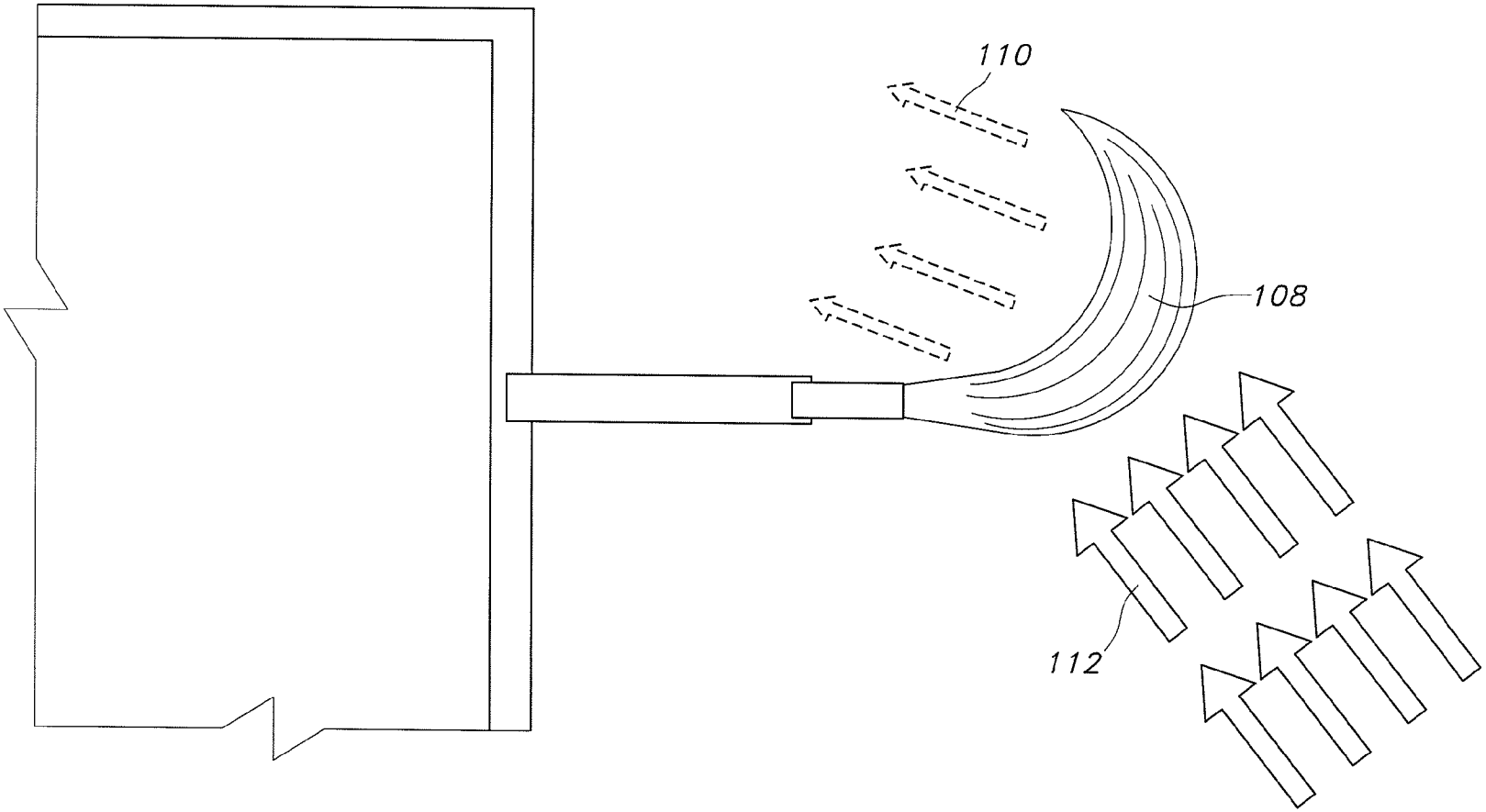
FIG. 1B is a top-down view of the burner of FIG. 1A subject to a crosswind.

FIG. 1A is a top-down view of a gas burner as used on an offshore platform. A burner nozzle 102 is generally disposed on the end of a burner arm 104 or similar structure, which is in turn fixed to a frame 106 or other primary platform structure. Combustible gases are sent to the burner nozzle 102 which ignites the gases, creating a burner flame 108. In relatively windless conditions, as depicted in FIG. 1, radiant heat 110 generated by the burner flame 108 is generally directed outwards from the burner nozzle 102. FIG. 1B, in contrast, is the same top-down view of the gas burner of FIG. 1A subject to a cross wind 112. As shown, the cross wind 112 impinges upon the burner flame 108, redirecting the burner flame 108 and its radiant heat 110 back towards the main structure of the platform. Due to this redirection, the burner flame 108 and its radiant heat 110 may present a significant safety issue to equipment and personnel located on the main platform structure.

Figure 2:
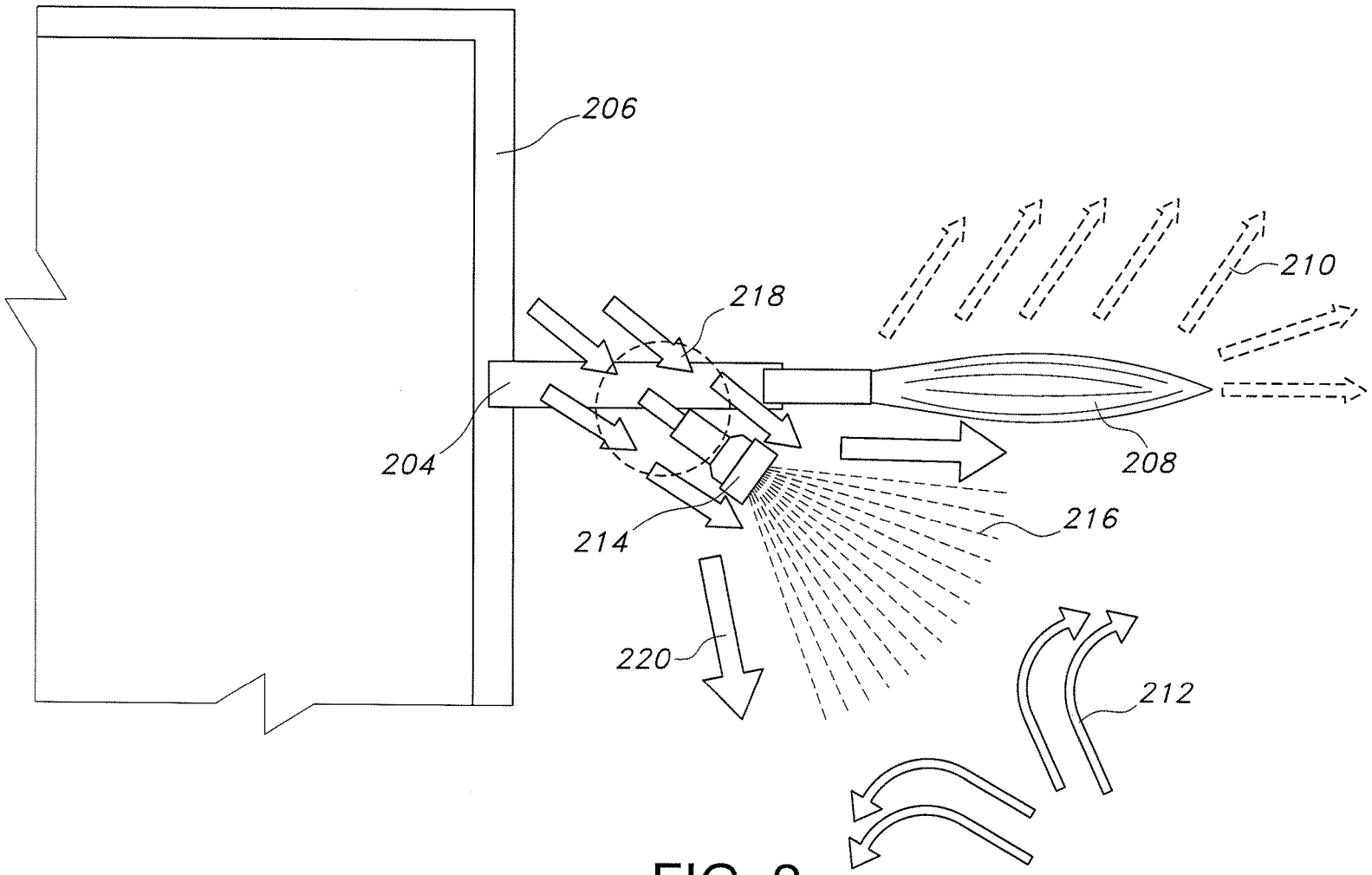
FIG. 2 is a top-down view of a burner of an offshore platform including a first embodiment of a burner flame control system in accordance with this disclosure.

FIG. 2 depicts a burner flame control system according to one embodiment of this disclosure. Similar to FIGS. 1A and 1B, the burner flame control system is depicted in the context of an offshore platform. A burner nozzle 202 is disposed on the end of a burner arm 204, which is in turn fixed to a frame 206 or similar structure of the offshore platform. A fluid nozzle 214 is also shown mounted on the burner arm 204. The fluid nozzle 214 is connected to a fluid supply system (not depicted) such that the fluid nozzle 214 is capable of producing a fluid spray 216. For purposes of this example, the fluid nozzle 214 is depicted as a fog nozzle, however, as discussed later in this disclosure, other nozzle types and arrangements may also be used in place of a fog nozzle for fluid nozzle 214.

Generally, the system of FIG. 2 prevents cross winds (or other similar air flows), such as cross wind 212, from impinging upon the burner flame 208 by generating a buffer air flow 220 that counteracts the cross wind 212. The buffer air flow 220 is generated by the fluid nozzle 214 as it dispenses the fluid spray 216. Specifically, in creating the fluid spray 216, an area of low pressure 218 is created behind the fluid nozzle 214, drawing air towards and around the fluid spray 216 and generating the buffer air flow 220. By directing the buffer air flow 220 towards the cross wind 212, at least a portion of the cross wind 212 can be redirected away from the burner flame 208 such that movement of the burner flame 208 that would have otherwise been caused by the cross wind 212 is reduced or eliminated.

Figure 3:
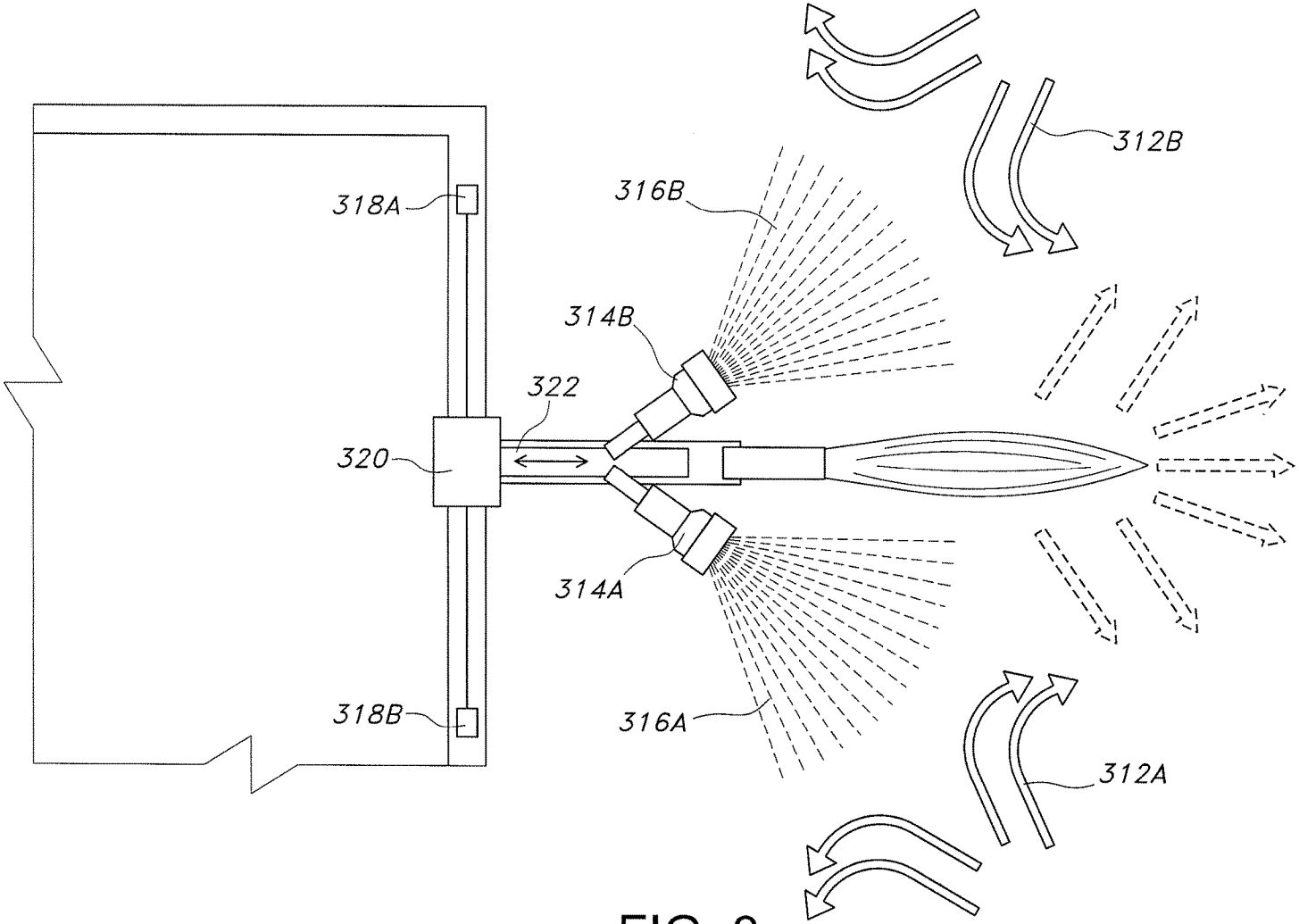
FIG. 3 is a top-down view of a burner of an offshore platform including a first embodiment of a burner flame control system in accordance with this disclosure.

Although the fluid nozzle 214 is depicted as being mounted on the burner arm 204, the current disclosure is not limited to such arrangements. For example, the fluid nozzle may be mounted on a separate arm or similar structure that positions the fluid nozzle such that the buffering effect described above is achieved. Moreover, as depicted in FIG. 3, a burner control system in accordance with this disclosure may include both a first fluid nozzle 314A and a second fluid nozzle 314B capable of producing sprays 316A, 316B and deflecting cross winds 312A, 312B, respectively. In burner flame control systems having more than one fluid nozzle, each fluid nozzle may be configured to operate individually, as part of a subset of fluid nozzles, or simultaneously with all other fluid nozzles. The fluid nozzles in an embodiment having multiple fluid nozzles are not limited to being mounted opposite each other, as depicted in FIG. 3. Rather, the fluid nozzles may be mounted such that the buffer air flows generated by the fluid nozzles are directed to the same side of the burner flame and/or directed to counteracting the same cross wind.

The fluid supply system may include any equipment suitable for delivering the fluid at a sufficient flow rate and pressure to create the buffering effect. Generally, the fluid supply system consists of at least one pump and suitable hosing or piping for conveying the fluid to the fluid nozzle. The fluid supply system may also include valves and other components for redirecting the fluid through the fluid supply system and a control system for operating the fluid supply system.

In the context of offshore platforms, the fluid supplied by the fluid supply system may be seawater pumped directly from the readily available water surrounding the offshore platform. However, the present disclosure is not limited to using seawater as the fluid provided to the fluid nozzles. Rather, the fluid may be any non-flammable liquid suitable for spraying by the fluid nozzles and for producing the described buffering effect. For example, the fluid may be a water-based mixture containing additives to vary the density of the fluid from that of untreated water. Another alternative is to include additives that lower the freezing point of the fluid so the fluid may be suitable for use in cold-weather applications.

The burner flame control system may include means for adjusting the fluid nozzle's spray pattern, position, and/or orientation, thereby adjusting the characteristics and direction of the buffer air flow generated by the fluid nozzle. The fluid nozzle may be manually adjusted by physically manipulating the fluid nozzle or by manually sending a command signal to a system capable of manipulating the fluid nozzle. The fluid nozzle may also be automatically adjusted by a control system using measurements from sensors and instrumentation to generate control signals for adjusting the fluid nozzle.

In one embodiment, the fluid nozzle may permit changes to the fluid nozzle's spray pattern. Such changes may include switching the fluid nozzle's spray pattern among a set of spray patterns including, but not limited to, conical, flat, jet, and fog/mist spray patterns. The Fluid nozzle may also be adjusted to change a parameter of a particular spray pattern. For example, if the fluid nozzle produces a conical spray pattern, the fluid nozzle may permit adjusting the angle between a wide angled and narrow angled cone.

In other embodiments, the position and/or orientation of the fluid nozzle may be adjusted. The mechanism to adjust the fluid nozzle position and/or orientation is not limited to any particular drive system. For example, the position of the fluid nozzle may be adjusted by moving the fluid nozzle along a track or by repositioning a mechanical arm or crane or extending or retracting a telescoping boom to which the fluid nozzle is attached. The fluid nozzle may also be coupled to a drive system for adjusting the orientation of the fluid nozzle once positioned.

To facilitate control, the burner flame control system may include one or more sensors for measuring parameters relevant to control of the burner flame. In one embodiment, the sensor measurements may be transmitted for viewing by an operator who is able to make manual adjustments to the burner flame control system in response to the measurements. In another embodiment, the sensor measurements may be used by a control system that automatically generates control signals for adjusting parameters of the burner flame control system.

Various types of sensors may be used in controlling the burner flame control system. For example, temperature sensors may be used to measure the temperature at a location-of-interest near the burner to determine how effectively the burner flame control system is redirecting heat from the burner flame. The location-of-interest may be any location from which an operator wants to take a temperature measurement but may specifically correspond to a location of a piece of equipment or a location accessible by personnel. One of skill in the art having the benefit of this disclosure would appreciate that any type of temperature sensor would be suitable for use in the burner flame control system. For example, the temperature sensor may be, but is not limited to, a thermometer (including an infrared thermometer), a thermocouple, a resistance temperature detector, or a pyrometer.

A chemical sensor may also be used to control the burner flame control system. For example, a chemical sensor may be used to detect combustion products created by the burner at locations-of-interest near the burner. The location-of-interest may be any location from which an operator wants to take a measurement of combustion products, but may specifically correspond to a location of a piece of equipment that may be affected by a particular combustion product or a location accessible by personnel to whom the combustion products may pose a health risk.

Wind sensors may also be used to determine the speed and/or direction of air flows that may impinge upon the burner flame. Examples of suitable wind sensors include, but are not limited to, anemometers (including mechanical an ultrasonic anemometers) and wind vanes.

In response to one or more measurements received from a sensor, the burner flame control system may adjust the spray pattern, position, or orientation of the fluid nozzle or the flow rate or pressure of fluid delivered by the fluid supply system. For example, in response to a change in wind direction, as measured by a suitable sensor, the burner flame control system could rotate a fluid nozzle such that the buffer air flow generated by the fluid nozzle more directly interacts with wind approaching from the new direction. If a temperature or chemical sensor measures values above a desired safety threshold, the burner flame control system could increase the flow and pressure of fluid delivered by the fluid nozzle, thereby increasing the buffer air flow generated by the fluid nozzle and increasing the buffering effect caused by the buffer air flow.

One of ordinary skill in the art would appreciate that any sensors, instrumentation, actuators, or other control-related equipment included in the burner flame control system, may be integrated into a broader control system. For example, a burner flame control system and its components may be integrated into a supervisory control and data acquisition (SCADA) system, a distributed control system (DCS), or a programmable logic controller (PLC) which is responsible for monitoring and controlling other equipment and systems, which may include other burner flame control system.

FIG. 3 depicts one embodiment that incorporates sensors and a drive system as discussed above. Specifically, fluid nozzles 314A and 314B may be mounted on a track 322 driven by a drive 320. The drive 320 may be configured to move one or both of fluid nozzles 314A and 314B linearly along the track 322 by a chain, gears, or other drive mechanism. The embodiment of FIG. 3 further includes a pair of sensors 318A and 318B that may be mounted on the main structure of the platform or in some other area of interest. Sensors 318A and 318B may be communicatively linked to drive 320 such that measurements by sensors 318A and 318B may be used as inputs by the drive 322 to control the position of the fluid nozzles 314A and 314B on the track. For example, sensors 318A and 318B may be temperature sensors and the drive 322 may be configured to move the fluid nozzles 314A and 314B based on the temperature measured by sensors 318A and 318B.

Although numerous characteristics and advantages of embodiments of the present invention have been set forth in the foregoing description and accompanying figures, this description is illustrative only. Changes to details regarding structure and arrangement that are not specifically included in this description may nevertheless be within the full extent indicated by the claims.

What is claimed is:

1. A method of controlling a burner flame exiting a burner nozzle, comprising:

providing a fluid to a fluid nozzle positioned in proximity to the burner nozzle;

creating a spray of the fluid from the fluid nozzle, the spray generating a first air flow around the spray of the fluid;

using the first air flow to counteract at least a portion of a second air flow;

providing the fluid to a second fluid nozzle adjacent to the burner nozzle; creating a second spray of the fluid from the second fluid nozzle, the second spray generating a third air flow around the second spray of the fluid; and using the third air flow to counteract at least a portion of one of the second air flow and a fourth air flow.

2. The method of claim 1, further comprising adjusting at least one of spray pattern, volumetric flow, and pressure of the spray.

3. The method of claim 1, further comprising changing at least one of the position and orientation of the fluid nozzle.

4. The method of claim 3, wherein at least one of the position and orientation of the fluid nozzle is changed in response to a measurement of a parameter by a sensor.

5. The method of claim 4, wherein the parameter is one of the group of temperature, wind speed, wind direction, and chemical concentration.

6. A system for directing a burner flame, comprising:

a fluid nozzle configured to receive a fluid from a fluid supply system and to create a spray, wherein the fluid nozzle is mountable in proximity to a burner nozzle such that when the fluid nozzle creates a spray, the spray generates a first air flow around the spray suitable to counteract at least a portion of a second air flow; and a second fluid nozzle configured to receive a fluid from a fluid supply system and to create a second spray, wherein the second fluid nozzle is mountable in proximity to the burner nozzle, such that when the second fluid nozzle creates a second spray, the second spray generates a third air flow suitable to counteract at least a portion of at least one of the second air flow and a fourth air flow.

7. The system of claim 6, further comprising a drive assembly coupled to the fluid nozzle, the drive assembly being configured to change at least one of the position and orientation of the fluid nozzle.

8. The system of claim 7, further comprising:

a sensor communicatively coupled to the drive assembly, wherein the drive assembly is further configured to change the position or orientation of the fluid nozzle in response to a measurement of a parameter by the sensor.

9. The system of claim 8, wherein the parameter is one of the group of temperature, wind speed, wind direction, and chemical concentration.

10. The system of claim 6, wherein at least one of spray pattern, volumetric flow, and pressure of the spray are adjustable.

11. The system of claim 6, wherein the fluid nozzle is a fog nozzle and the spray is conical in shape.

12. A burner system, comprising:

a burner nozzle for producing a burner flame;

a fluid nozzle mounted in proximity to the burner nozzle;

a fluid supply system connected to the fluid nozzle for providing fluid to the fluid nozzle, wherein the fluid nozzle is configured to create a spray when the fluid supply system provides fluid to the fluid nozzle, the spray generating a first air flow around the spray, the first air flow being suitable to counteract at least a portion of a second air flow; and a second fluid nozzle configured to be mounted in proximity to the burner nozzle and to receive fluid from the fluid supply system, wherein the second fluid nozzle is further configured to create a second spray when the second fluid nozzle receives fluid form the fluid supply system, the second spray generating a third air flow around the second spray, the third air flow being suitable to counteract at least a portion of at least one of the second air flow and a fourth air flow.

13. The burner system of claim 12, further comprising a drive assembly coupled to the fluid nozzle, the drive assembly being configured to change at least one of the position and orientation of the fluid nozzle.

14. The burner system of claim 13, further comprising:

a sensor communicatively coupled to the drive assembly, wherein the drive assembly changes the position or orientation of the fluid nozzle in response to a measurement of a parameter by the sensor.

15. The burner system of claim 14, wherein the parameter is one of the group of temperature, wind speed, wind direction, and chemical concentration.

16. The burner system of claim 12, wherein at least one of spray pattern, volumetric flow, and pressure of the spray are adjustable.

17. The burner system of claim 12, wherein the fluid nozzle is a fog nozzle and the spray is conical.

* * * * *